United States Patent [19]

Strickland et al.

[11] Patent Number: 4,614,326

[45] Date of Patent: Sep. 30, 1986

[54] CONCRETE MOLD CORE ASSEMBLY

[75] Inventors: James K. Strickland; H. Grady Ivey, both of Jacksonville, Fla.

[73] Assignee: Strickland Systems, Inc., Jacksonville, Fla.

[21] Appl. No.: 690,046

[22] Filed: Jan. 9, 1985

[51] Int. Cl.[4] ..... B28B 7/30

[52] U.S. Cl. ..... 249/180; 249/27; 249/152; 249/184; 249/194

[58] Field of Search ..... 249/27, 152, 178, 180, 249/184, 193, 194, 121, 63

[56] References Cited

U.S. PATENT DOCUMENTS

| | | | |
|---|---|---|---|
| 2,827,683 | 3/1958 | Benart et al. | 249/180 |
| 3,565,390 | 2/1971 | Beasley | 249/180 |
| 3,570,801 | 3/1971 | Miller | 249/152 |
| 3,844,526 | 10/1974 | McCracken | 249/152 |
| 3,853,452 | 12/1974 | Delmonte | 249/180 |
| 3,934,808 | 1/1976 | Alzawa | 249/27 |
| 4,088,296 | 5/1978 | Armas | 249/180 |
| 4,252,291 | 2/1981 | Armas | 249/27 |

*Primary Examiner*—Jay H. Woo
*Assistant Examiner*—James C. Housel
*Attorney, Agent, or Firm*—Banner, Birch, McKie & Beckett

[57] ABSTRACT

A concrete mold core assembly for casting catch basins and the like has outwardly facing form panels disposed to form a box with at least two corner members being located at diametrically opposite corners of the box between spaced adjoining edges of the panels and a lid overlies the ends of the form panels and corner members. Each corner member provides opposite side surfaces defining a tapered wedge that matingly interengages with the spaced adjoining edges of the form panels such that when the corner members are moved outwardly the core assembly is expanded into its casting condition and when moved inwardly the panels and members are stripped from the hardened concrete. The lid is coupled to the upper ends of the corner members to be raised to casting condition when the members are moved outwardly and lowered to be stripped from the hardened concrete when the members are moved inwardly.

5 Claims, 18 Drawing Figures

CONCRETE MOLD CORE ASSEMBLY

FIELD OF THE INVENTION

The invention relates generally to concrete form work and more particularly is directed to improvements in automatically operated mold core assemblies for casting the inside surfaces of concrete structures such as catch basins, storm drains, drop inlets, etc.

BACKGROUND OF THE INVENTION

There are a variety of proposals in the prior art relating to concrete form work and assembly of its components, either manually or with some degree of automation. Various forms of apparatus have been suggested to facilitate the positioning of concrete form panels to accomodate the specialized situation where a mold core is needed to carry out concrete casting of catch basins, burial vaults, septic tanks and the like.

A desired objective to achieve through the use of a mold core assembly is obtaining smooth surfaces as free of joint lines as possible once the form panels and associated components are stripped from the hardened concrete. It is also important that as simple a construction as possible be employed, involving a minimum of components and certainly avoiding the necessity for use of a variety of detachable or detached elements which could easily be subject to being separated or lost from the overall mold core assembly.

Generally, the prior art mold core assemblies have been unable to achieve the above described desirable attributes of providing a unitized apparatus, that is automatically operable while being simple and effective in casting catch basins and the like. Such simple and effective automatic operation necessarily involves both setting up the form panels and related components preliminary to concrete pouring and thereafter stripping of these panels and components from the hardened concrete structure.

A principal object of the instant invention is to provide a mold core assembly utilizing outwardly facing form panels providing external casting faces with the core assembly being effectively automatic both in setting up and in stripping the form panels and other components against which the concrete is cast.

Another significant object of the invention is to provide a unitized mold core assembly which is self contained such that all elements making up the assembly may be automatically manipulated, essentially without independent support for any of the elements of the core assembly.

It is a further object of the instant invention to provide a mold core assembly which is totally automated, simple in construction and easily subject to being hydraulically operated from any suitable hydraulic pressure source.

An additional object of this invention is to provide a mold core assembly embodying outwardly facing form panels, elongate corner members and a lid overlying the ends of the form panels and corner members wherein all of the components making up the core assembly are integrated into a unitary assembly with the corner members being movable inwardly from diametrically opposite corners of the core assembly to collapse the entire assembly and outwardly to expand the entire core assembly into its casting condition.

SUMMARY OF THE INVENTION

In brief, the invention embodies an integrated core assembly to be utilized in concrete construction of various box like structures such as drop inlets, catch basins, storm drains, etc. The mold core assembly has outwardly facing form panels disposed to form a box with at least two corner members being located at diametrically opposite corners of the box between spaced adjoining edges of the panels. A lid ovelies the ends of the form panels and the corner members. Each corner member provides opposite side surfaces defining a tapered wedge that matingly interengages with the spaced adjoining edges of the form panels such that when the corner members are moved outwardly the core assembly is expanded into its casting condition and when moved inwardly the panels and members are stripped from the hardened concrete. The lid is coupled to the upper ends of the corner members to be raised when the members are moved outwardly and lowered to be stripped from the hardened concrete when the members are moved inwardly.

A preferred embodiment the mold core assembly with its integrated form panels, corner members and lid is suitable for casting a box having dimensions in the order of 2'×2'×3'. In this embodiment there are two corner members one at each of two diametrically opposite corners of the box formed by the mold core assembly. Further, the form panels are provided by two panels fixedly joined perpendicular to each other to form the other two diametrically opposite corners of the box. For larger size mold core assemblies it is desirable to have an active corner member at each corner of the core assembly with individual generally planar form panels extending between each adjacent pair of corner members to define the four sides of the box shape to be cast by the core assembly. With these larger size mold core assemblies employing active corner members at each of the four corners of the core assembly, it is advantageous to employ inside corner form units employing the shorter actuator, yoke and other components such as disclosed in Strickland et al. application Ser. No. 577,356 filed Feb. 6, 1984.

Preferably, the concrete mold core assembly is energized through utilization of pressurized hydraulic fluid. This has the advantage of being able to easily conduct the pressurized fluid to one or several actuators that may be located in confined positions where access to operating personnel could be difficult. Conventional hydraulic hoses can be led from these actuators to hydraulic fluid controls and the pressurized hydraulic fluid source.

The operation of the lid in conjunction with actuating the form panels and corner members involves coupling the lid to the upper ends of the corner members utilizing mating cams and guide pins carrying retainer means which act such that the lid is raised when the corner members are moved outwardly and lowered when the corner members are moved inwardly.

BRIEF DESCRIPTION OF THE DRAWINGS

The foregoing objects as well as others will become apparent through consideration of the following detailed description of a preferred embodiment of the invention given in connection with the accompanying illustrations on the attached drawings in which.

DETAILED DESCRIPTION OF AN ILLUSTRATIVE EMBODIMENT

Figure 1:
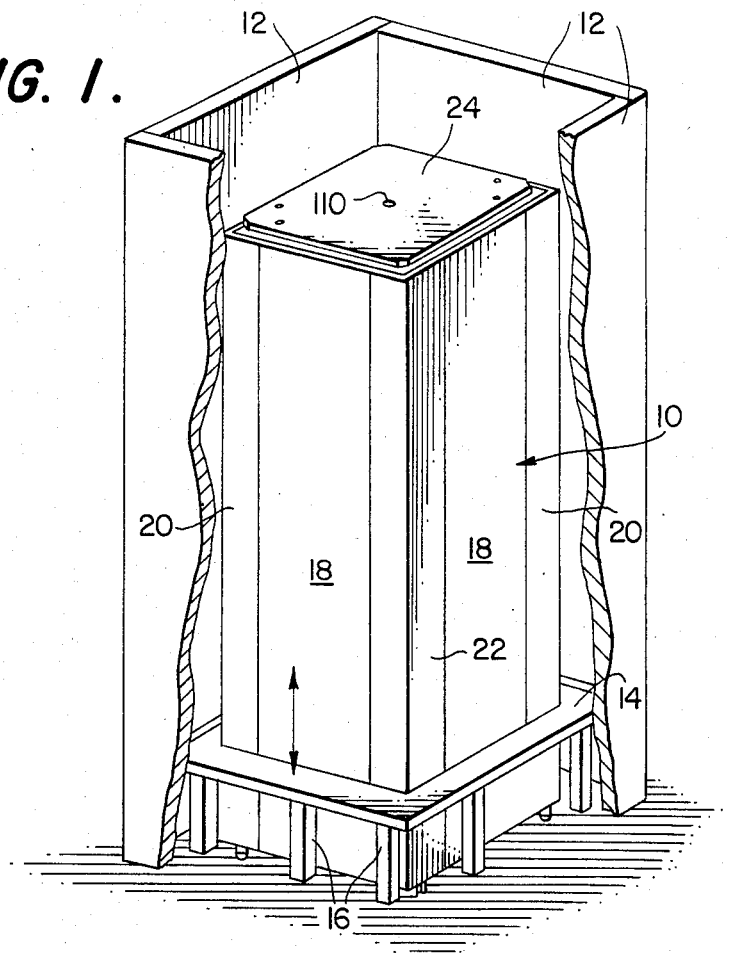
FIG. 1 is a perspective view with a portion of the diagramatically illustrated external concrete form work broken away to reveal the mold core assembly of this invention in a concrete casting environment.

On FIG. 1, the concrete mold core assembly 10 is shown appropriately mounted in a concrete casting environment. A diagramatic showing of external form work panels 12 is included to complete an understanding of the casting environment in which mold core assembly 10 may be suitably used. A portion of these exterior form work panels 12 is broken away to expose the core assembly 10. These exterior form work panels 12 may be of conventional construction and form no part of the invention.

Further on FIG. 1, a rectangular collar 14 is shown encircling the mold core assembly 10. Collar 14 is supported on upstanding blocks 16 to dispose collar 14 at the desired height above ground level. It will be readily recognized that depending upon the depth of the catch basin or other box structure that is to be cast, the blocks 16 may be shorter or longer. Blocks 16 dispose collar 14 at the desired level beneath the top of the core assembly 10 to give the desired interior depth for the box that is being cast.

With the mold core assembly 10 disposed as shown in FIG. 1, the collar 14 held at the desired elevation on the blocks 16 and the external form work panels 12 mounted in place to enclose both core assembly 10 and collar 14, the concrete may be poured onto the upper face of collar 14 in the space between the external casting faces of core assembly 10 and the internal faces of form work panels 12. Appropriate reinforcing steel rods may be mounted in the space between core assembly 10 and form work panels 12 as well as over the top of core assembly 10 to reinforce the cast box, all in accordance with known concrete casting practices.

To the extent that the components of the mold core assembly 10 can be visualized from FIG. 1, the assembly has outwardly facing panels 18 disposed to form a box with adjoining edges of these panels 18 at diametrically opposite corners of this box being spaced. Elongate corner members 20 are disposed between the adjoining edges of the panels 18 at diametrically opposite corners of the box. The form panels are completed by a corner column panel 22 which fixedly joins two panels 18 to provide the form panels at the two diametrically opposite corners of the box that are not provided with the activating elongate corner members 20.

To complete the mold core assembly 10, to the extent shown on FIG. 1, a lid 24 is provided overlying the ends of the panels 18, corner members 20 and corner column panels 22. As will be explained in detail hereinafter, the lid 24 is coupled to the upper ends of corner members 20 such that the lid is raised when the corner members 20 are moved outwardly and lowered when the corner members 20 are moved inwardly.

Figure 2:
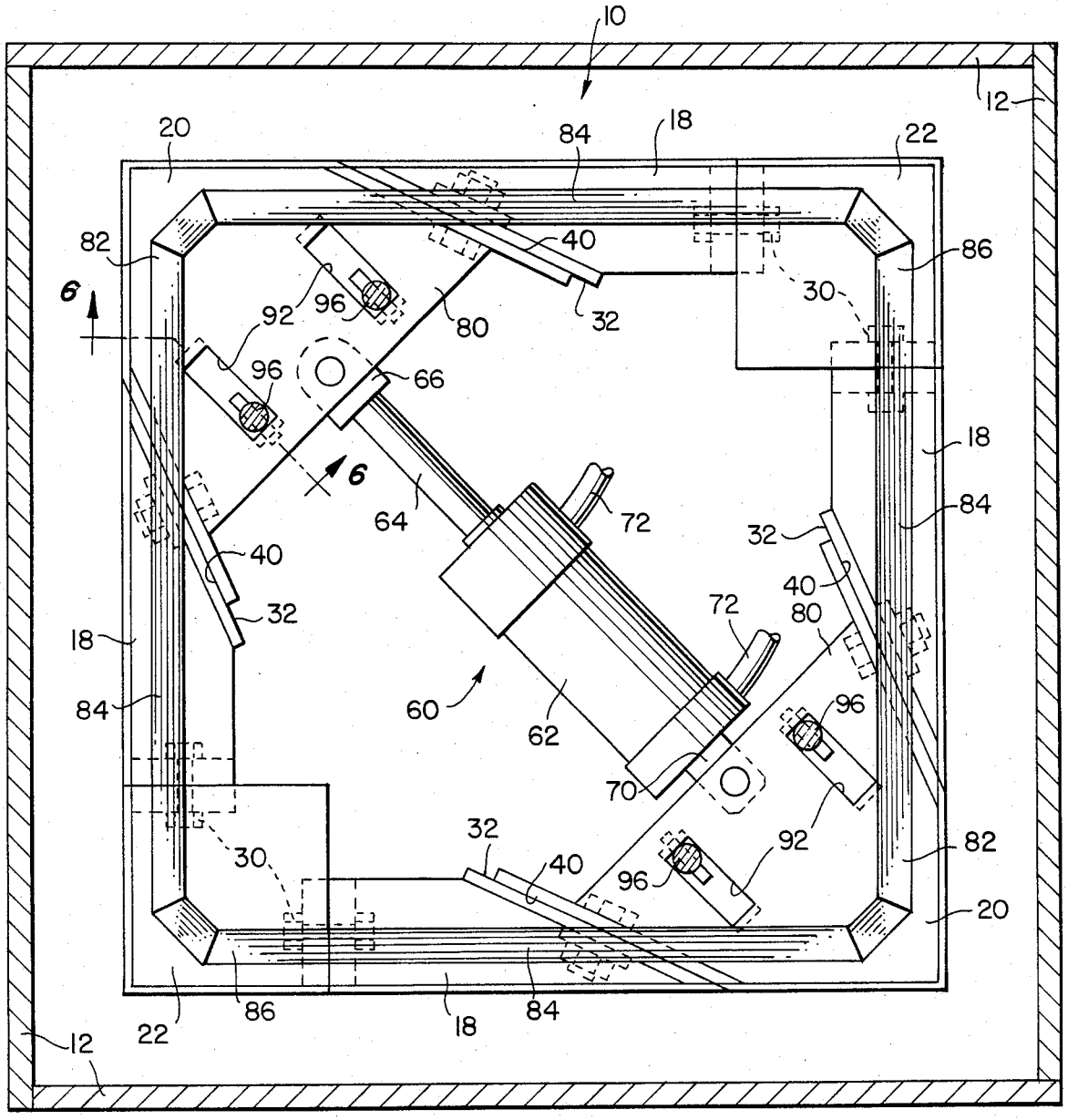
FIG. 2 is a plan view of the mold core assembly in its expanded casting condition with the lid of the assembly removed and the diagramatically illustrated external form work in section.
Figure 3:
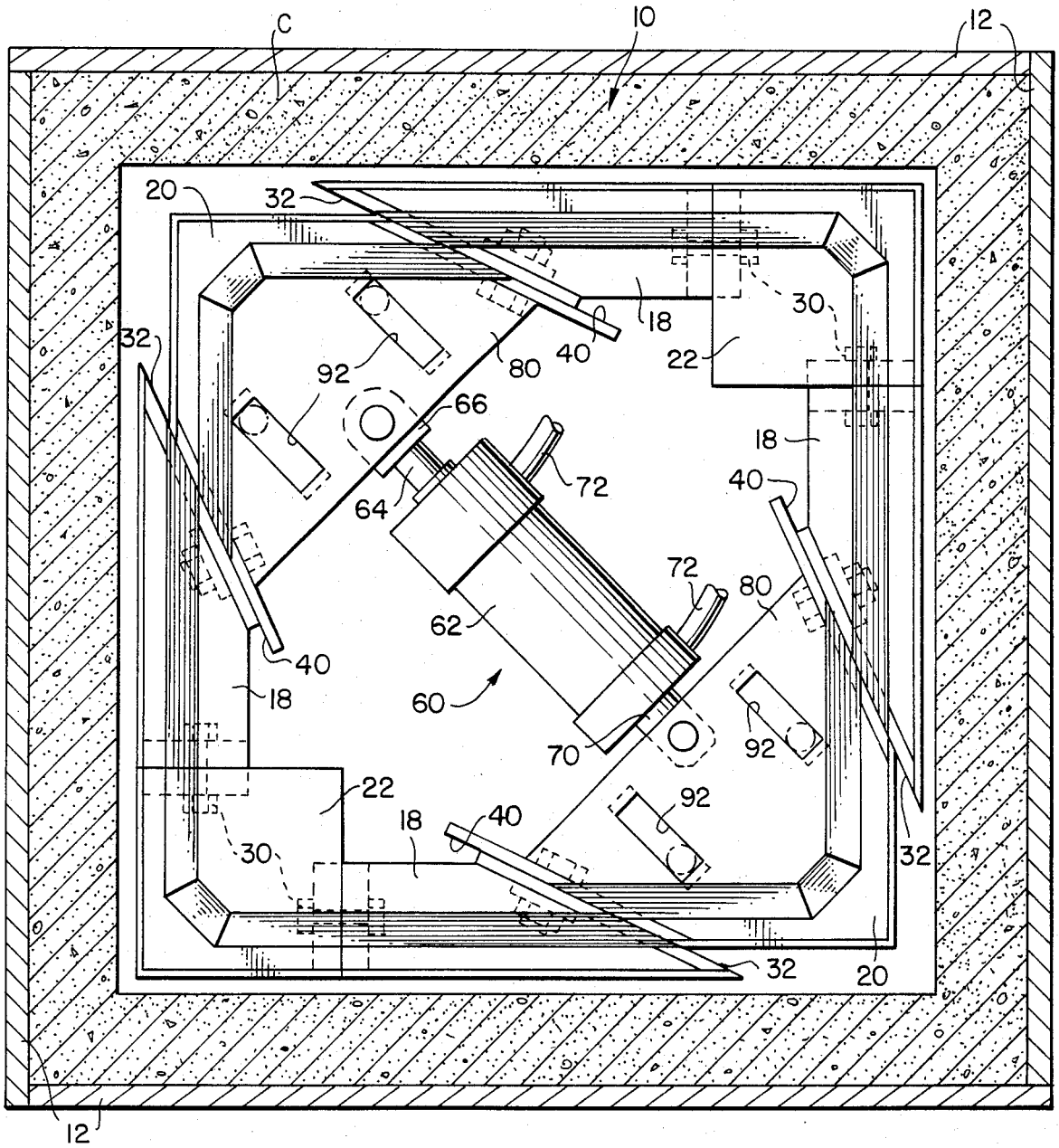
FIG. 3 is a view similar to FIG. 2 but illustrating the core assembly collapsed after a concrete casting operation and stripping of the form panels and corner members from the hardened concrete.

FIG. 2 shows the mold core assembly 10 in expanded casting condition. In FIG. 3, assembly 10 is shown collapsed with the form panels made up of panels 18 and column panels 22 as well as corner members 20 stripped from the hardened concrete. The lid 24 has been removed in both FIGS. 2 and 3 to better illustrate the working components involved in the panels 18, corner members 20 and corner column panels 22.

It will be readily recognized that in the position of the components shown for the mold core assembly 10 on FIG. 2 in its expanded casting condition, concrete may be poured into the rectangular space between the external casting faces provided on core assembly 10 and the internal faces of the exterior form work panels 12. Then after the concrete C has hardened as shown on FIG. 3, the mold core assembly 10 is collapsed to the condition as shown on this Figure thereby stripping the panels 18, corner members 20 and corner column panels 22 from the hardened concrete.

As may be best seen on FIGS. 2 and 3. The form panels are provided by a pair of panels 18 being fixedly joined by bolt and nut fasteners 30 to adjacent side faces of the corner column panels 22 so that these panels 18 are perpendicular to each other. This provides two form panel subassemblies which form two of the diametrically opposite corners of the box defined by the mold core assembly 10.

Figure 4:
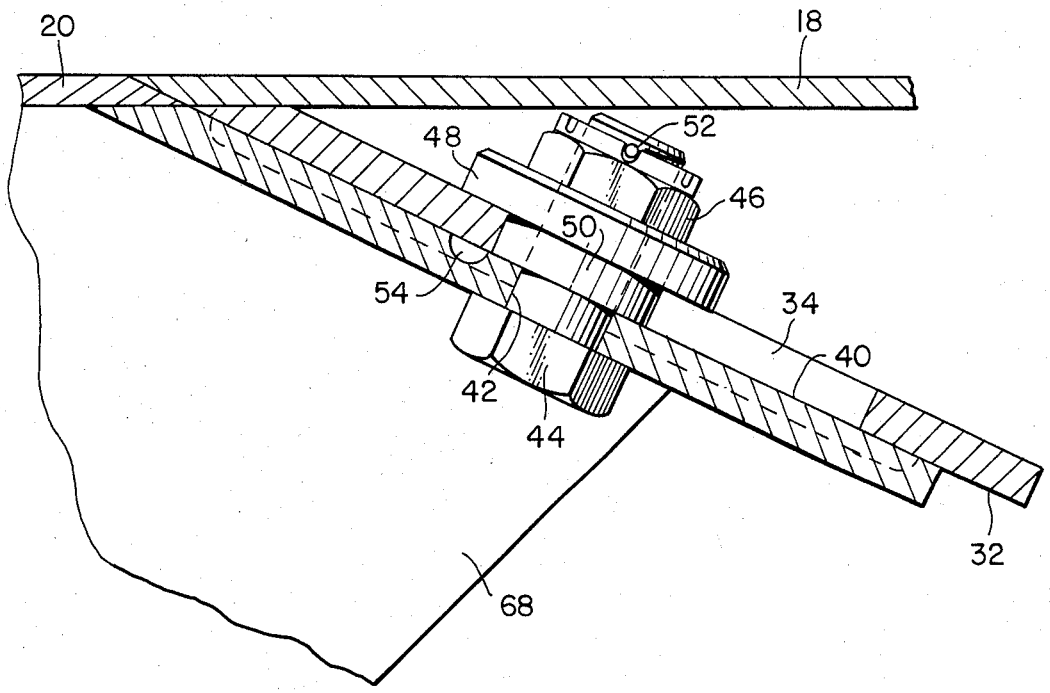
FIG. 4 is a detailed sectional view taken on line 4—4 of FIG. 6.
Figure 5:
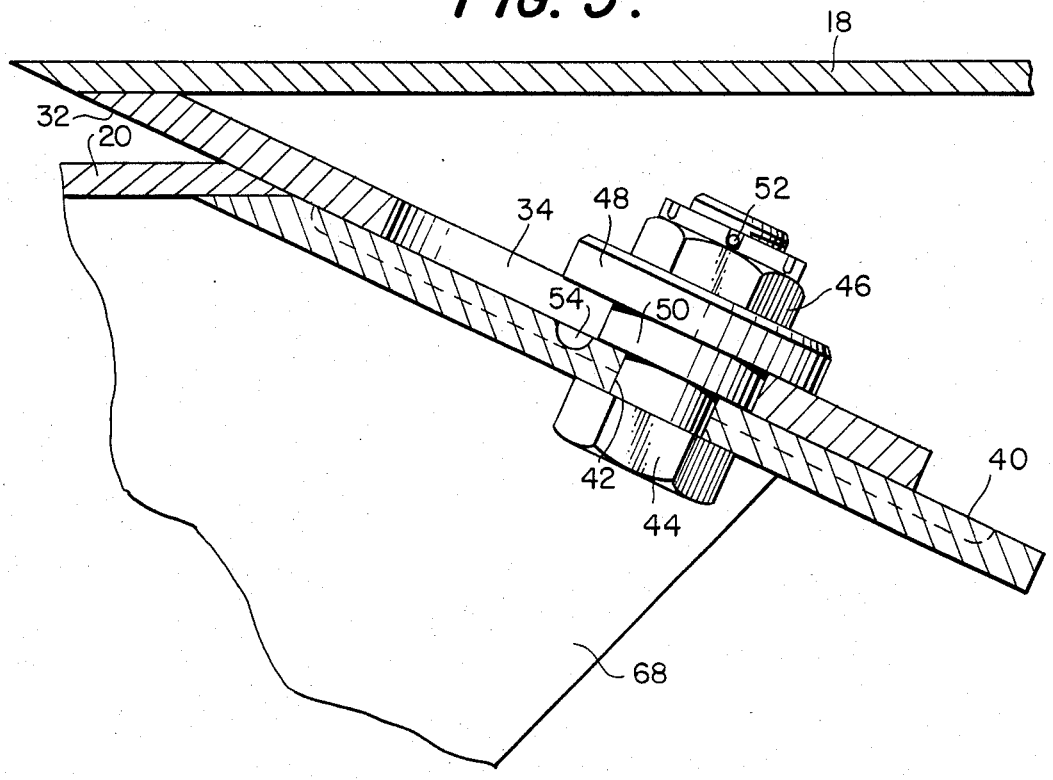
FIG. 5 is a sectional view similar to FIG. 4 but showing the relationship of the components with the corner member positioned inwardly relative to the adjoining edges of the adjacent form panels.
Figure 12:
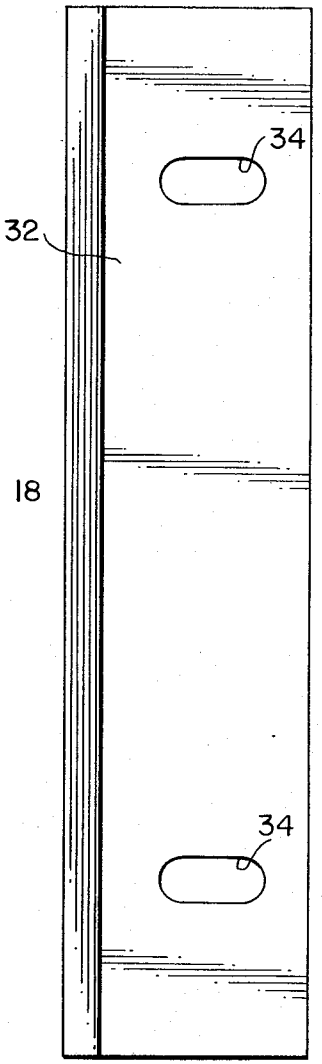
FIG. 12 is an elevational view of a guide surface on an edge of the form panel which mates with the side surface on the corner member of FIG. 11.

At the other two diametrically opposite corners of this box, the adjoining edges of the panels 18 are spaced. These spaced edges are each provided with a guide surface 32, this guide surface being disposed at an acute angle of 25° relative to the casting face of the panel 18. As may be best seen from FIGS. 4, 5 and 12 each guide surface 32 is provided with a pair of spaced, elongated slots 34.

Each of the elongate corner members 20 provides an external casting face which bridges the space between the guide surfaces 32 on the adjoining edges of the panels 18. Each corner member 20 has opposite side surfaces 40 which define a tapered wedge on the corner member 20. These side surfaces 40 on corner member 20 matingly and slidably interengage with the guide surfaces 32 on panels 18.

The guide surfaces 32 and side surfaces 40 are maintained in sliding interengagement during relative movement between the corner member 20 and panels 18 by a connecting means passing through bore 42 formed in each side surface 40 of the corner member 20. This connecting means may take the form of a shoulder bolt 44 threadably engaged with a castellated nut 46. A washer 48 underlies the nut 46 and an anti-friction bearing 50 is supported by the shoulder bolt 44 to lie within the elongated slot 34. This connecting means would preferably have the nut 46 tightened down onto bolt 44 to the desired extent and a cotter pin 52 passed through the stem of bolt 44 to ensure retention of nut 46 in the proper location on bolt 44 during operation of the mold core assembly 10.

Figure 11:
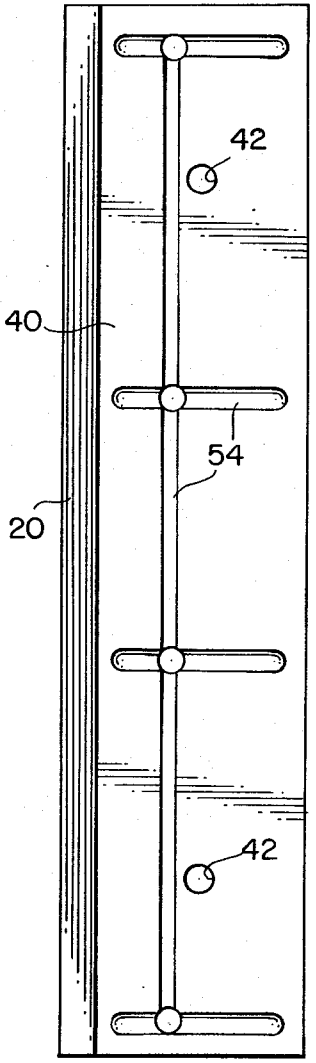
FIG. 11 is an elevational view of a side surface of a corner member.

To maintain the antifriction bearing 50 lubricated and promote free sliding interengagement between the guide surfaces 32 on panels 18 and opposite side surfaces 40 on corner members 20, the bolt 44 may be centrally and laterally bored to have a grease fitting (not shown) threaded thereinto. Then, lubricating grease may be introduced into the bolt 44 to promote free-sliding between the interengaged surfaces and keep the antifriction bearing 50 properly lubricated. To ensure adequate distribution of any lubricating medium that is introduced, a network of surface grooves 54 is formed in each of the opposite side surfaces 40 (see FIG. 11). Thus lubrication introduced into and through bolt 44 will be well distributed over the slidingly interengaged guide surfaces 32 and side surfaces 40.

To move the corner members 20 and thereby shift the mold core assembly 10 from its expanded casting condition as shown on FIG. 2 to its collapsed condition where the panels 18, corner members 20 and corner column panels 22 have been stripped from the hardened concrete as shown in FIG. 3, axially extensible actuators 60 are connected to the diametrically opposite corner members 20. Each actuator 60 extends diagonally between two diametrically opposite corners of the mold core assembly 10. Preferably, the actuators 60 are hydraulically activated, each actuator having a cylinder 62 housing a piston (not shown) with the piston rod 64 connected to such piston having a clevis 66 at its outer end that is connected to a bridging plate 68 which is welded transversely of the interior of corner member 20 to extend between the opposite side surfaces 40 of the corner member. The end of cylinder 62 of each actuator 60, opposite piston rod 64, is provided with a clevis 70 that is pin connected to a bridging plate 68 on the diametrically opposite corner member 20. Thus the actuators 60 extend diagonally between two diametrically opposite corners of the mold core assembly 10, ideally positioned to effectively move the corner members 20 inwardly from the diametrically opposite corners of the mold core assembly 10 to collapse the assembly and outwardly to expand the assembly 10 into its casting condition as shown in FIG. 2.

It will be easily visualized from FIGS. 2 and 3 that under this controlled movement effected by actuators 60, the form panel sub subassemblies, each made up of a corner column panel 22 to which are bolted a pair of panels 18, will be moved from their outer extended position as shown on FIG. 2 to their collapsed condition as shown on FIG. 3. This movement is effectively controlled by the corner wedge defined by the side surfaces 40 on each corner member 20 sliding along the guide surfaces 32 on the panels 18, these mating surfaces being connected and constrained to be maintained in interengagement by the connecting means shown in detail on FIGS. 4 and 5.

Hydraulic hose connections 72 are coupled to the opposite ends of the cylinder 62 of each actuator 60 to thereby conduct pressurized hydraulic fluid into the appropriate end of the cylinder and exhaust fluid from the opposite end of the cylinder, all in accordance with known hydraulic control techniques to obtain the desired extension and contraction of the actuators 60 as desired.

Figure 10:
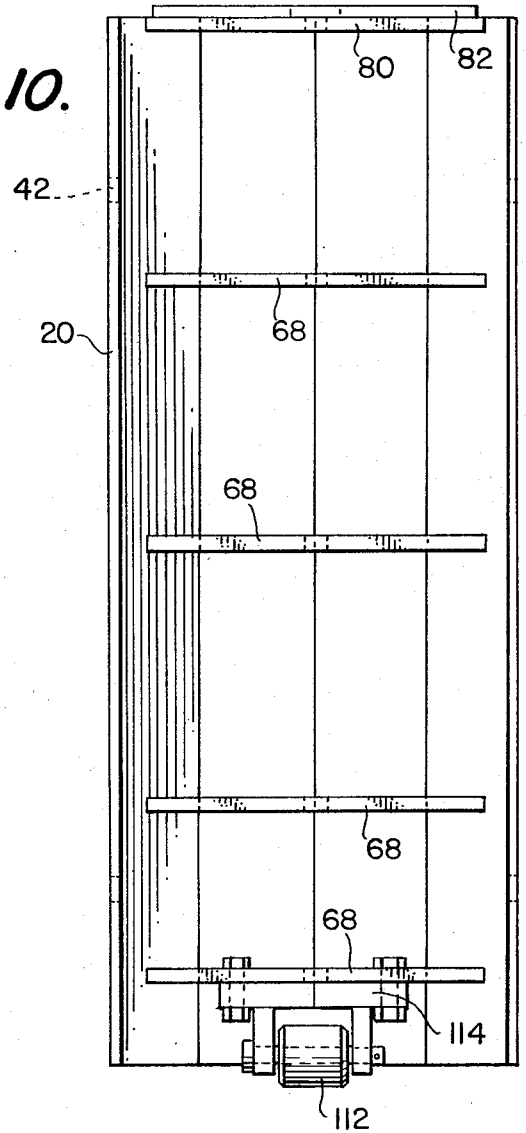
FIG. 10 is an elevational view of the interior of a corner member.
Figure 9:
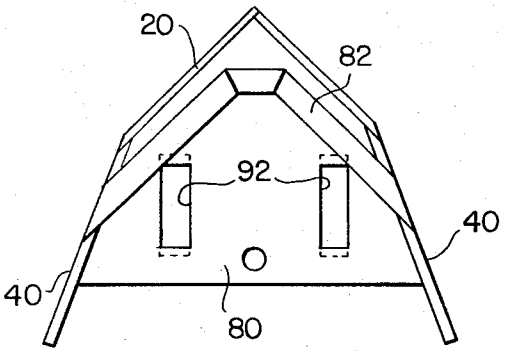
FIG. 9 is a plan view of the upper end of a corner member.
Figure 13:
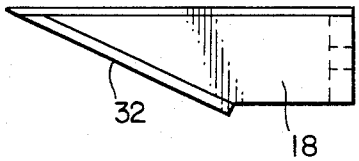
FIG. 13 is a plan view of a form panel.
Figure 15:
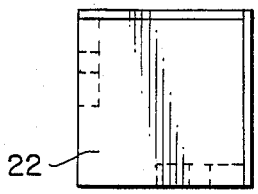
FIG. 15 is a plan view of a corner column panel employed to fixedly join two panels perpendicular to each other to provide form panels at two diametrically opposite corners of the box formed by the mold core assembly.
Figure 14:
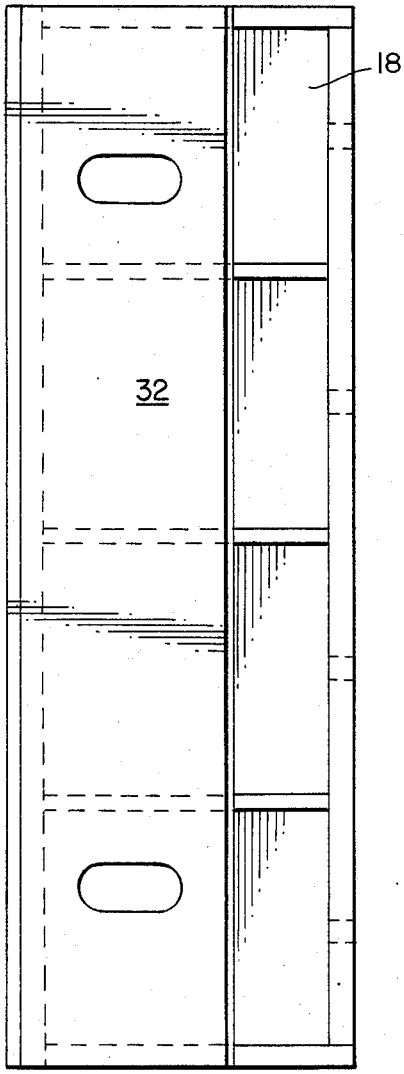
FIG. 14 is a side elevational view of the form panel of FIG. 13.
Figure 16:
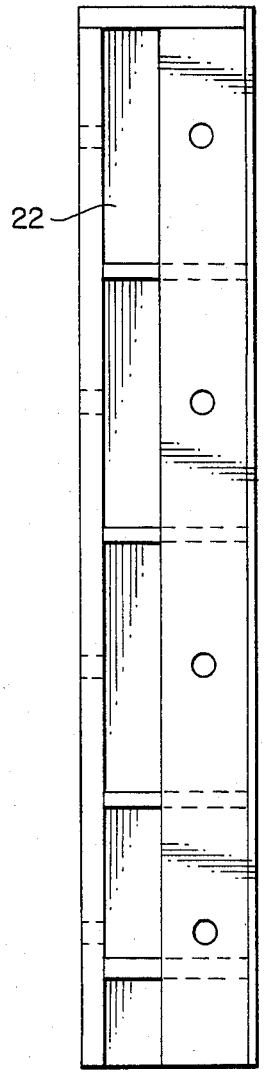
FIG. 16 is a side elevational view of the corner column panel of FIG. 15.

It will be understood that, depending upon the height of the mold core assembly 10 which may vary with the size of the catch basin or other box structure intended to be cast in concrete, two or more actuators 60 may be employed located at different heights along the length of the mold core assembly 10. Thus, as may be visualized from the FIG. 10 showing of the interior of a corner member 20, several bridging plates 68 may be provided welded transversely between the opposite side surfaces 40 of the corner member 20. Then the desired number of actuators 60 at different levels within the mold core assembly 10 may be connected to these bridging plates 68 to obtain the desired actuating force both in expanding the mold core assembly 10 to its casting condition and in moving in the corner members 20 to offer the required force to strip panels 18, corner members 20 and corner column panels 22 from the hardened concrete.

Figure 17:
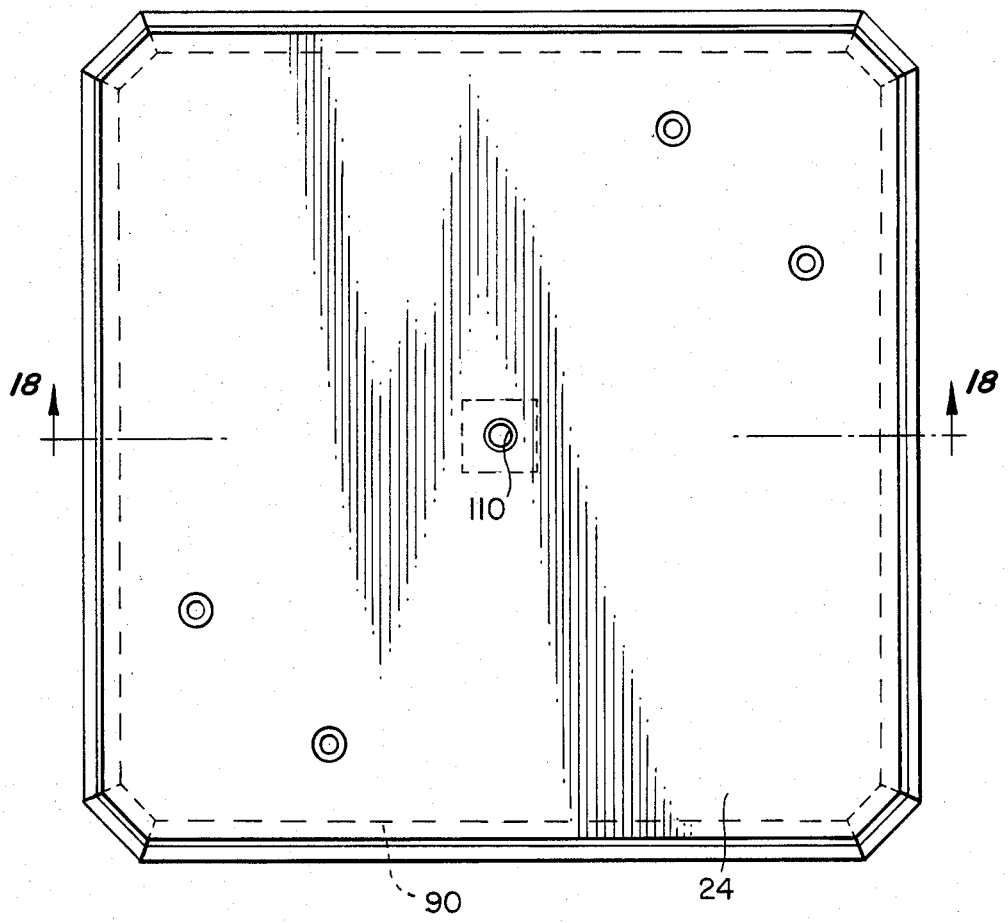
FIG. 17 is a plan view of a lid for the mold core assembly.
Figure 18:
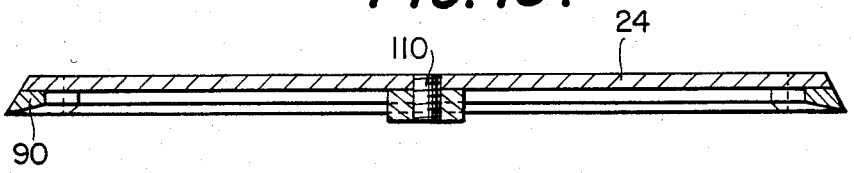
FIG. 18 is a sectional view taken on line 18—18 of FIG. 17.

As has been mentioned with reference to FIG. 1, the mold core assembly 10 to cast a concrete box shape such as a catch basin is completed by being provided with a lid 24. Lid 24 overlies the ends of the panels 18, corner members 20 and corner column panels 22. This lid is coupled to the upper ends of the corner members 20 such that the lid is raised when the corner members 20 are moved outwardly to the casting condition for the core assembly 10 as shown in FIG. 2 and in turn the lid is lowered when the corner members 20 are moved inwardly to the collapsed condition as shown in FIG. 3. The construction of the lid is shown in FIGS. 17 and 18. For an understanding of the manner in which the lid 24 is coupled to the upper ends of corner members 20 reference may best be made to FIGS. 6, 7 and 8.

The upper end of each of corner member 20 is provided with a control plate 80. Plate 80 is welded transversely within the confines of corner member 20 similar to bridging plates 68 but, control plate 80 is located at the uppermost end of the control member 20 to carry out the major control function in manipulating lid 24.

The control plate 80 on corner member 20 carries an upwardly facing and outwardly inclined cam strip 82. This cam strip generally follows the perimeter of the upper end of the corner member 20 with the strip lying adjacent to the casting faces of the corner member. A similar upwardly facing and outwardly inclined cam strip 84 extends along the upper end of each panel 18 and a corresponding upwardly facing and outwardly inclined cam strip 86 is provided on the upper end of each corner column panel 22. Each of these cam strips lies adjacent the casting faces of the component upon which it is carried. Also, each has a cross-section configuration as may be best seen on FIGS. 6 and 7.

Thus, as may be seen from FIG. 2, cam strips 82, 84 and 86 collectively provide an upwardly facing and outwardly inclined cam extending entirely around the perimeter of the upper end of the panels 18, corner panels 20 and corner column panels 22, providing a continuous cam strip extending around the perimeter adjacent the casting faces of the corner members, panels and corner column panels.

A mating strip cam 90 is welded along the perimeter of the underside of the lid 24. With a configuration of lid 24 as shown in plan on FIG. 17, it will be appreciated that the strip cam 90 encircling the perimeter of lid 24 will matingly cooperate with the cam strips 82, 84 and 86 when the mold core assembly 10 is expanded to its casting condition as shown in FIG. 2.

Figure 6:
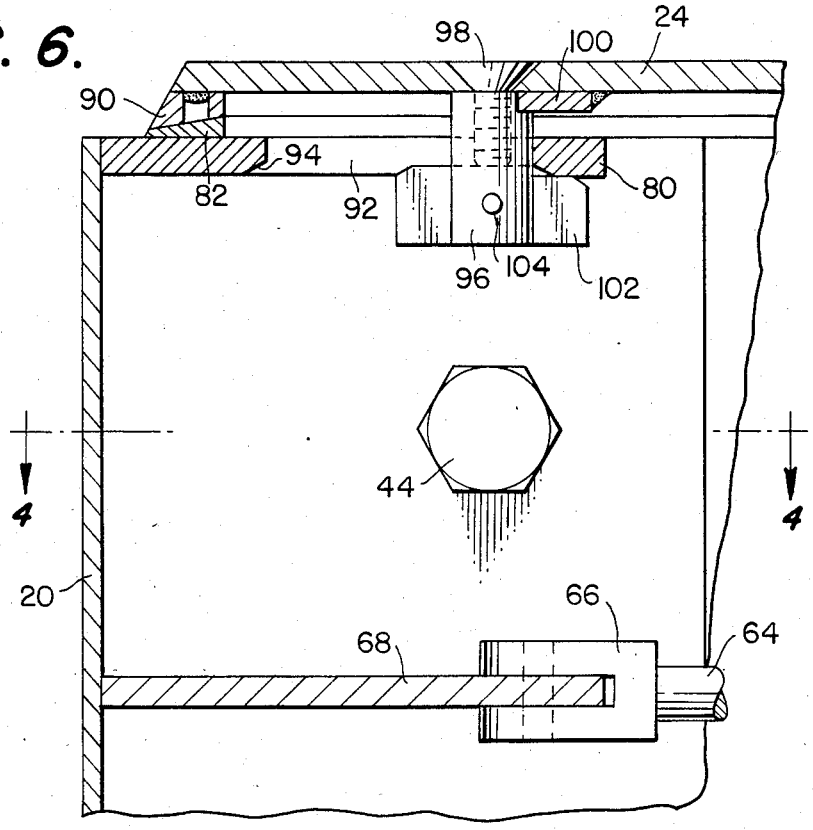
FIG. 6 is a detailed sectional view taken on line 6—6 of FIG. 2.

The mated relation between cam strip 82 and strip cam 90 in this casting condition for the mold core assembly 10 may be seen in FIG. 6. Similarly, when the corner members 20 are moved inwardly by actuators 60 to the condition shown in FIG. 3, cam strip 82 and strip cam 90 on lid 24 will be separated as shown in section on FIG. 7.

Figure 7:
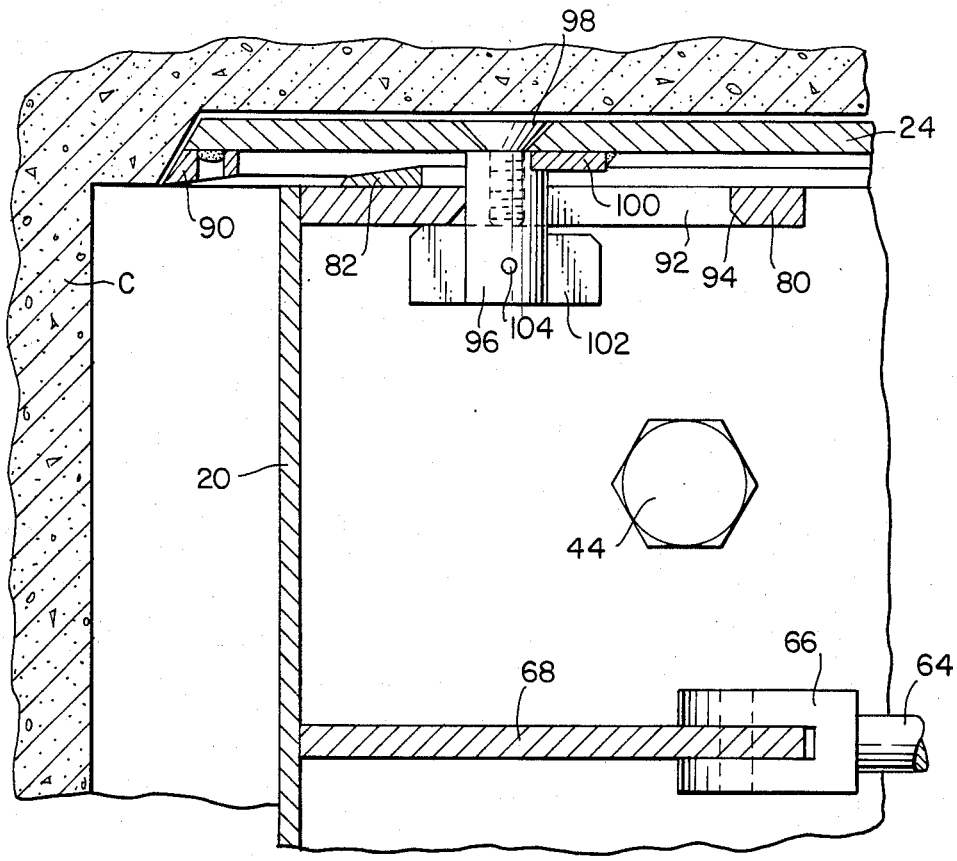
FIG. 7 is a view similar to FIG. 6 but showing the corner member at its inner position stripped from the cast concrete and the lid in its lowered position after being stripped from the hardened concrete.
Figure 8:
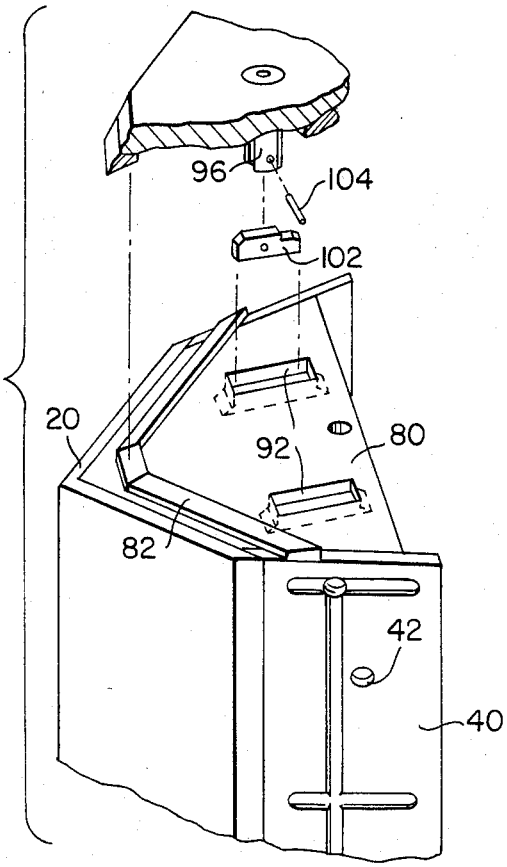
FIG. 8 is an exploded partial perspective view showing components making up the coupling between the lid and the upper end of a corner member.

During this inward movement of the corner member 20 as the cam strip 82 and strip cam 90 disengage, the lid 24 is lowered to the position shown on FIG. 7 relative to the upper end of the corner member 20. However, if the lid 24 is to be stripped from a hardened concrete surface lying there above, activating forces must be applied to the lid 24 to physically pull it down and strip it from the hardened concrete surface. This stripping force is applied by coupling the lid 24 to the upper ends of the corner members 20 utilizing the control plate 80 of each corner member 20.

Each control plate 80 is provided with a pair of parallel guide slots 92. The opposite ends of each slot 92 are beveled at 94 on the underside of control plate 80 for a control purpose as will be explained.

As may be best seen from FIGS. 2 and 3, these slots 92 in plates 80 are aligned parallel with the axis of actuators 60. Thus, in the extension and retraction of actuators 60 and consequent moving of corner members 20 inwardly and outwardly, the aligned state of slots 92 provides guided alignment for positive control in coupling the lid 24 to the upper ends of the corner members 20 as will be apparent from the following description.

A guide pin 96 for each slot 92 is fixedly secured to the underside of lid 24 by a screw 98 threaded into the end of pins 96. To secure the pin 96 in a predetermined location against rotation therefrom, the base of each pin as a flattened section with a holding bar 100 engaged in this flattened section, the bar being welded to the underside of lid 24. The lower end of each pin 96 is slotted to receive a retainer bar 102, such bar having a configuration a shown in perspective on FIG. 8. The retainer bar 102 is held in the slotted end of pin 96 by dowel pin 104.

It will be noted that the upwardly facing ends of each retainer bar 102 are beveled to cooperate in operation of the mold core assembly 10 with the beveled surfaces 94 at the ends of slots 92 on the underside of control plate 80. If also is pointed out that the inner end of retainer bar 102 is stepped to have a lesser height at that end than at the outer end of bar 102. This stepped lesser height configuration allows the lid 24 to be at its raised height as shown in FIG. 6 while the greater height of bar 102 on the outer end of the bar assures that the lid 24 is drawn down to strip it from the hardened concrete in the manner shown on FIG. 7.

The interengagement between the parallel slots 92 in control plates 80 and the guide pins 96 fixedly secured to the underside of lid 24 provides particular advantages in the overall operation of the mold core assembly. The cooperative effect between slots 92 and guide pins 96 gives the assembly effective squaring devices at the corners where the slots 92 and guide pins 96 cooperate. Thus, the overall mold core assembly is assured of being maintained in a perfectly squared condition by reason of this particular coupling of the lid 24 to the upper ends of the corner members 20.

In operation of the above described raising and lowering of the lid 24, it is pointed out that in the outer extreme position of the corner member 20 as shown in FIG. 6, the lid is held by one end of bar 102 underlying the control plate 80. In the opposite extreme inward position of corner member 20 as shown in FIG. 7, the other end of bar 102 underlies control plate 80 such that in both of these extreme positions the lid 24 is positively held by the retainer bars 102 engaging the underside of control plates 80 of the corner members 20.

However, it is to be noted that retainer bars 102 are shorter than the length of the slots 92. Thus, with the corner members 20 moved to an intermediate position such that retainer bars 102 are essentially centered within the length of slots 92, the lid 24 may be lifted off of the remainder of the mold core assembly 10 with the retainer bars 102 simply passing up through the slots 82.

To facilitate lifting the lid 24 off of the remainder of the mold core assembly 10 or to lift the entire assembly 10 with the lid coupled to the corner members 20 in the fashion shown in either FIGS. 6 or 7 the lid may be provided with a reinforced threaded aperture 110, as shown on FIGS. 17 and 18. The threaded stem of an appropriate lifting eye bolt may be threaded into the aperture 110 to lift the lid 24 and/or the entire mold core assembly 10.

To facilitate moving the mold core assembly 10 across a supporting surface, the assembly may be provided with suitable rollers 112 such as shown on FIG. 10. Thus, a roller 112 carried by a bracket 114 may be bolted to the lowermost bridging plate 68 in each of the corner members 20. These rollers 112 project only a slight distance beneath the lower end of the mold core assembly 10 but support it at a sufficient elevation that the mold core assembly 10 can be rolled to facilitate its positioning at a desired concrete casting location.

When the mold core assembly 10 is supported at the desired location and assembled with other compoments such as suggested in the diagramatic illustration of FIG. 1, the mold core assembly 10 under the control of actuators 60 is expanded to its casting condition. Concrete is then poured between the external casting faces of the mold core assembly 10 and the interior faces of the external form work panels 12.

Once the poured concrete has hardened, the actuators 60 may again by hydraulically activated, this time to move the corner members 20 inwardly from the diametrically opposite corners of the assembly 10 to collapse the core assembly and strip the form panels and corner members from the hardened concrete. Incident to this latter inward movement of the corner members 20, the mating cam surfaces 82 and 90 between the control plates 80 of corner members 20 and lid 24 will move out of engagement allowing the lid 24 to be stripped from the hardened concrete thereabove. As the outer beveled ends of retainer bars 102 move into engagement with the beveled surfaces 94 on the underside of control plates 80, the interengagement between these beveled surfaces will act to forceably cam and draw the lid 24 down away from the hardened concrete until the components assume the position as shown in FIG. 7. At this stage, the cast concrete product in the form of a five sided box may be readily lifted off of the mold core assembly 10, leaving such assembly in readiness for reuse in casting another box product.

Should, for one reason or another, access be necessary to the interior of the mold core assembly 10, it is merely necessary to utilize the actuators 60 to move the corner members 20 to an intermediate position whereat the retainer bars 102 carried by lid 24 are generally centered relative to the length of slots 92. In this position, a lifting eye bolt may be engaged in threaded aperture 110 of lid 24 and the lid freely lifted off of the remainder of the mold core assembly 10, thereby providing free access to the interior of the mold core assembly.

It will be obvious from the above discussed apparatus embodiment that various other variations and modifications of the apparatus of this invention are possible and such will readily occur to those skilled in the art. Accordingly, the scope of this invention is not to be limited by the embodiment disclosed, but is to include any such embodiments as may be encompassed within the scope of the claims appended hereto.

We claim:

1. A concrete mold assembly for casting catch basins and the like comprising:

outwardly facing form panels providing external casting faces, said panels being disposed to form a box with adjoining edges of said panels at diametrically opposite corners of said box being spaced, said spaced edges being provided with opposed guide surfaces each of which is disposed at an acute angle relative to the adjacent casting face;

an elongate corner member disposed between said adjoining edges of said form panels providing an external casting face bridging the space between said adjoining edges, said member having opposite side surfaces defining a tapered wedge on said corner member, said side surfaces matingly and slidably interengaging with said guide surfaces of said form panels;

means connecting said side surfaces to said guide surfaces to maintain sliding interengagement between said surfaces during relative movement between said corner member and said form panels;

means for moving the corner members inwardly from said diametrically opposite corners to collapse said core asembly and outwardly to expand said core assembly into its casting condition;

a lid overlying the ends of said form panels and said corner members;

means positively coupling said lid to the upper ends of said corner members whereby said lid is raised when said members are moved outwardly and positively lowered when said members are moved inwardly, said coupling means including cam means for raising and lowering the lid, said cam means comprising a first cam surface carried on the underside of the lid, and second cam surfaces mating with said first cam surface carried by the upper ends of said corner members and said form panels, respectively.

2. A concrete mold core assembly for casting catch basins and the like comprising:

outwardly facing form panels providing external casting faces, said panels being disposed to form a box with adjoining edges of said panels at diametrically opposite corners of said box being spaced, said spaced edges being provided with opposed guide surfaces each of which is disposed at an acute angle relative to the adjacent casting face;

an elongate corner member disposed between said adjoining edges of said form panels providing an external casting face bridging the space between said adjoining edges, said member having opposite side surfaces defining a tapered wedge on said corner member, said side surfaces matingly and slidably interengaging with said guide surfaces of said form panels;

means connecting said side surfaces to said guide surfaces to maintain sliding interengagement between said surfaces during relative movement between said corner member and said form panels;

means for moving the corner members inwardly from said diametrically opposite corners to collapse said core asembly and outwardly to expand said core assembly into its casting condition;

a lid overlying the ends of said form panels and said corner members;

means coupling said lid to the upper ends of said corner members whereby said lid is raised when said members are moved outwardly and lowered when said members are moved inwardly, said coupling means including mating cam means for raising and lowering the lid carried by said lid, said upper ends of said corner members and said form panels, and further including guide slots formed in said upper ends of said corner members, guide pins carried by said lid slidably engaged in said slots, and retainer means on each of said pins to lockingly engage with said upper ends of said corner members at both the inner and outer positions of said corner members.

3. A concrete mold core assembly as recited in claim 2 wherein said cam means includes a cam surface extending along the perimeter of the underside of said lid and a mating cam surface extending along said upper ends of said corner members and said from panels adjacent the casting faces of said members and panels, respectively.

4. A concrete mold core assembly as recited in any one of claims 1 or 3 wherein there are two said corner members one at each of two diametrically opposite corners, and said form panels are provided by two panels fixedly joined perpendicular to each other by a corner column panel to form the other two diametrically opposite corners of said box.

5. A concrete mold core assembly as recited in claim 4 wherein said moving means comprises an axially extensible actuator connected to said two corner members with said actuator extending diagonally between said two diametrically opposite corners.

* * * * *